United States Patent [19]

Sommer

[11] Patent Number: 4,899,122

[45] Date of Patent: Feb. 6, 1990

[54] TRANSFORMER, CHOKE AND THE LIKE

[75] Inventor: Friedrich-Wilhelm Sommer, Soest, Fed. Rep. of Germany

[73] Assignee: ABB CEAG Licht- und Stromversorgungstechnik GmbH, Soest, Fed. Rep. of Germany

[21] Appl. No.: 280,167

[22] Filed: Dec. 5, 1988

[30] Foreign Application Priority Data

Dec. 5, 1987 [DE] Fed. Rep. of Germany ... 8716135[U]

[51] Int. Cl.[4] ..... H01F 27/26

[52] U.S. Cl. ..... 336/65; 336/92; 336/210

[58] Field of Search ..... 310/217, 218; 336/65, 336/98, 67, 210, 92

[56] References Cited

U.S. PATENT DOCUMENTS

| | | | |
|---|---|---|---|
| 1,632,101 | 6/1927 | Thordarson | 336/210 X |
| 2,741,528 | 4/1956 | Clark et al. | 336/98 |
| 2,762,988 | 9/1956 | Pomazal et al. | 336/210 |

FOREIGN PATENT DOCUMENTS

| | | |
|---|---|---|
| 959033 | 2/1957 | Fed. Rep. of Germany . |
| 1026383 | 3/1958 | Fed. Rep. of Germany . |
| 685334 | 12/1952 | United Kingdom . |
| 772137 | 4/1957 | United Kingdom . |

*Primary Examiner*—Thomas J. Kozma

*Attorney, Agent, or Firm*—Herbert L. Lerner; Laurence A. Greenberg

[57] ABSTRACT

A transformer, choke or the like includes a magnetic core assembled from two lamination packets formed of laminations layered in a given direction. The lamination packets have outer contacting surfaces defining a partition line therebetween. A weld seam transverse to the given direction fastens the contacting surfaces to one another and overlaps the partition line. A fastening element fastens the transformer, choke or the like to a floor or a wall. Upright tabs formed on the fastening element have free edges alongside the partition line being partially welded with the weld seam.

4 Claims, 2 Drawing Sheets

Figures 2, 2A:
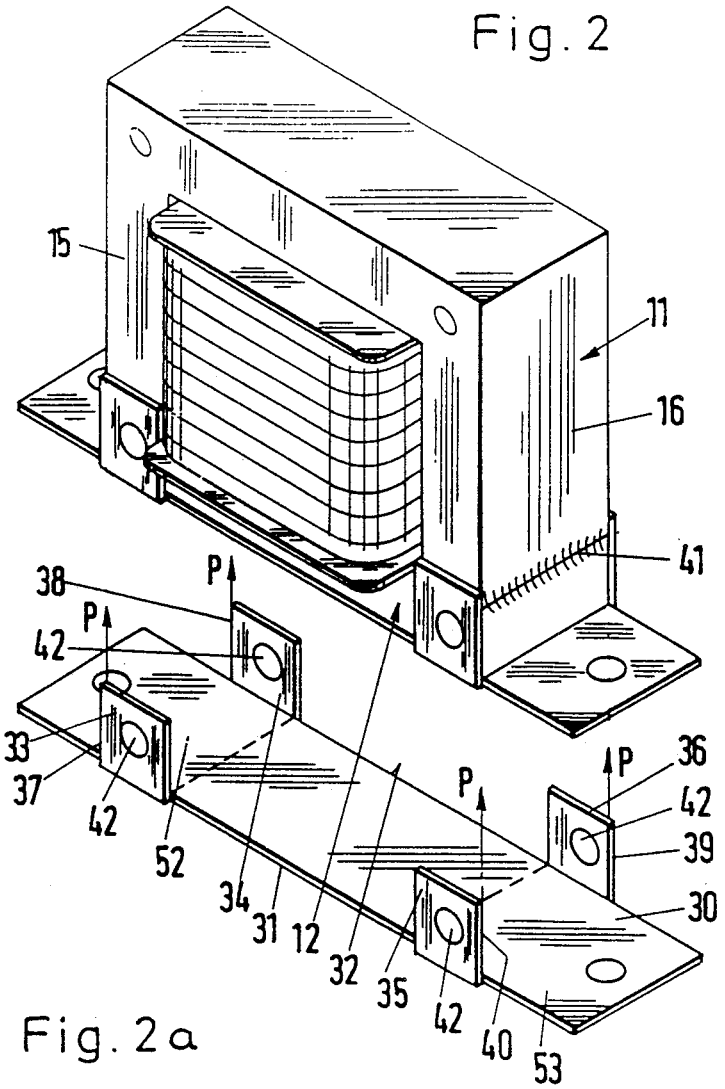

Fig.1
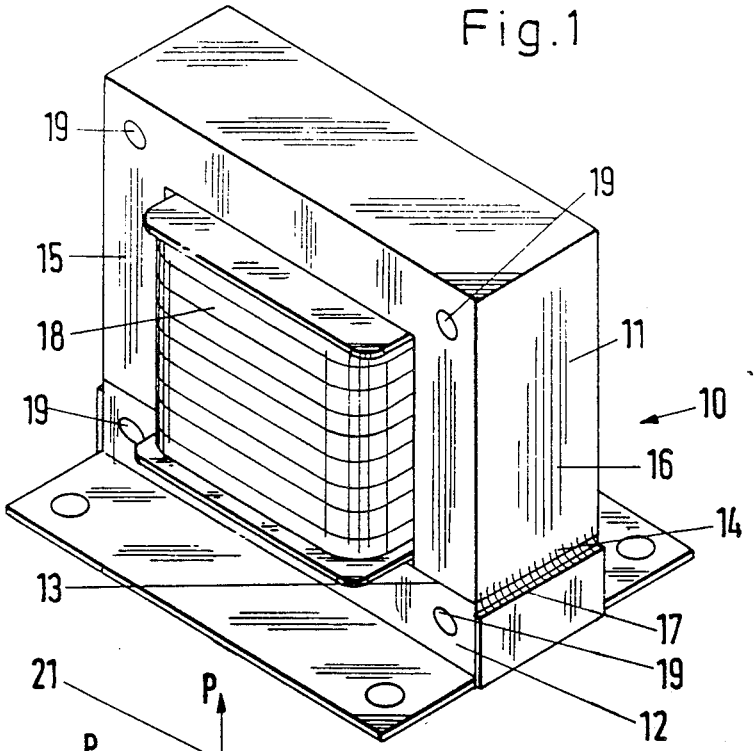
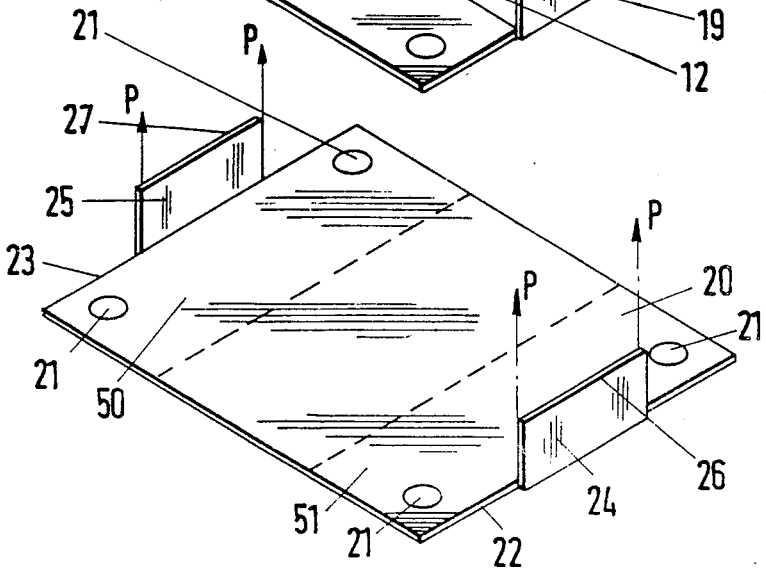
Fig.1a

TRANSFORMER, CHOKE AND THE LIKE

The invention relates to a transformer, choke and the like having a magnetic core assembled from two lamination packets formed of laminated plates, the packets being fastened to one another on outer contacting surfaces thereof by a weld seam being transverse to the lamination layering and overlapping the partition line, and a fastening element for fastening the transformer, choke and the like to a floor or a wall.

Transformers of this type have a magnetic core and a magnetic coil and are used as small transformers in power packs, for example. The magnetic cores of such small transformers are formed of two lamination packets assembled from laminated plates. They have either an E or a T section, which are assembled with a further lamination packet to make a closed core. If one lamination packet has an E section, then the lamination packet to be added to it is either constructed simply as a kind of rectangular block or has a T section, with the cross bar of the T overlapping the outer two ends of the legs and the vertical bar of the T cooperating with the middle bar, of the E section. Optionally, an air gap is formed. In the case of a T section, the mating part may also have a U shape. In both cases, these partition lines between the contacting surfaces on the outer surface of the legs are overlapped by means of a weld seam extending transversely to the lamination layering, and both partial packets are thus joined together.

In order to enable the transformers to be fastened in a housing of a power pack, fastening elements in the form of angled base elements are attached. The fastening elements have a screw hole so that the transformer can be screwed firmly to the intended location in the housing. Since the angled base element must be attached later, the production cost of the transformer is increased.

It is accordingly an object of the invention to provide a transformer, choke and the like, which overcomes the hereinafore-mentioned disadvantages of the heretofore-known devices of this general type and in which the attachment of fastening elements is simplified.

With the foregoing and other objects in view there is provided, in accordance with the invention, a transformer, choke or the like, comprising a magnetic core assembled from two lamination packets formed of laminations layered in a given direction, the lamination packets having outer contacting surfaces defining a partition line therebetween, a weld seam transverse to the given direction fastening the contacting surfaces to one another and overlapping the partition line, a fastening element for fastening the transformer, choke or the like to a floor or a wall, and upright tabs formed on the fastening element, the upright tabs having free edges alongside the partition line being partially welded during the production of the weld seam.

In accordance with another feature of the invention, the lamination packets have opposite outer surfaces transverse to the given direction with a given spacing therebetween, the fastening element is a bottom lamination protruding beyond both sides of the lamination packets in the given direction and having two opposite edges spaced apart exactly as far as the given spacing, a respective one of the tabs is bent upright perpendicular to the bottom lamination on each of the two opposite edges of the bottom lamination, the free edges of the tabs are parallel to the bottom lamination and disposed in the vicinity of the partition line, and the production of the weld seam at the partition line simultaneously incorporates the free edges of the tabs.

In accordance with a further feature of the invention, the lamination packets have a given lamination layering width (or height if the device is mounted on a wall) and length, the fastening element is a bottom lamination having edges parallel to the laminations being mutually spaced apart by a distance corresponding to the given width, the tabs are bent upward on both of the edges of the bottom lamination, besides the free edges, each of the tabs on one of the edges of the bottom lamination having first edges facing each other and second edges facing away from each other transverse to the bottom plate, the first edges being mutually spaced apart by a distance corresponding to the given length, portions of the second edges are disposed in the vicinity of the partition line, and the second edges are overlapped by the weld seam.

In accordance with a concomitant feature of the invention, the tabs have bores formed therein each being in alignment with rivet bores formed in one of the lamination packets for riveting the tabs together.

In all cases, the tabs of the fastening elements are welded together directly, jointly with and during the welding process for joining the two lamination packets, so that no additional operations are required for fastening the fastening elements. This eliminates the need for producing screw connections at assembly stations. Furthermore, neither extra welding equipment nor the associated handling times are required. A further advantage is that all of the laminations or plates have a secure ground connection with the fastening element, so that a separate grounding weld seam can be dispensed with.

In the manufacture of the weld seam, all of the laminations or plates must be pressed against one another with great force. In order to enable high-quality firm welding of the tabs, a pressing force of the tabs against the lamination packets is also necessary. As a result, once the welding has been finished, the thermal coupling between the laminations or plates and the fastening elements is also optimal.

The invention is used not only in transformers but naturally also in chokes in which core laminations or plates are joined together with a weld seam in the same manner as described above. Therefore, according to the invention, the free edges or at least portions of the free edges of the tabs are jointly incorporated into the weld seam, simultaneously with the production of the weld seam for joining the core laminations or plates of core lamination packets.

Other features which are considered as characteristic for the invention are set forth in the appended claims.

Although the invention is illustrated and described herein as constructed in a transformer, choke and the like, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

FIG. 1 is a diagrammatic perspective view of an entire first embodiment of the invention including a fastening element;

FIG. 1*a* is a perspective view of the fastening element of FIG. 1 alone;

FIG. 2 is a view similar to FIG. 1 of a further embodiment of the invention; and FIG. 2*a* is a perspective view of the fastening element of FIG. 2 alone.

Referring now to the figures of the drawing in detail and first, particularly, to FIG. 1 thereof, there is seen a transformer 10 having two core lamination packets 11 and 12, which are assembled from individual laminations and have a partition line 14 formed along contacting surfaces 13 thereof. A respective weld seam 17 that extends transversely to the lamination or plate layering overlaps the partition line at outer surfaces of each of two legs 15 and 16, so that the two lamination packets 11, 12 are joined together, or in other words welded.

The shape of the two core laminations is of little significance for the invention. The core lamination packet 11 may be constructed in the form of an E section, while the core lamination packet 12 is merely in the form of a transverse bar that overlaps the two outer legs 15 and 16, or the core lamination packet 11 may be constructed in the shape of a U, while the core lamination packet 12 is T-shaped, with a vertical bar thereof being located in the interior of a coil 18.

In order to enable fastening of the transformer 10 to a floor or a wall, a bottom lamination or plate or fastening element 20 is provided, which protrudes on both sides past the transformer or the two core lamination packets 11 and 12 in the direction of the layering of the plates, so that space is provided for screw holes 21. Tabs 24 and 25 which extend from edges 22 and 23, are transverse to the individual laminations or plates in the assembled state. The length of the tabs in the direction of the edges 22 and 23 is equivalent to the thickness of the core lamination packets 11 and 12, so that they protrude beyond the core lamination packets on both sides in the direction of the core laminations or plates. For assembly, the tabs are bent upward, so that edges 26 and 27 thereof are located precisely in the vicinity of the partition line 14 on the outer surfaces of the legs 15 and 16. When the partition line 14 is welded closed, the edges 26 and 27 on the two sides are simultaneously incorporated into the weld seam, so that the bottom lamination or plate or fastening element 20 is also fastened to the transformer core.

A further embodiment of the invention can be seen in FIG. 2. Instead of a bottom lamination or plate protruding beyond the transformer core transversely to the layering direction, a bottom lamination or plate or fastening element 30 is provided which is an elongated rectangle, that protrudes past the transformer core on both outer surfaces of the legs 15 and 16. Four tabs in the form of two pairs 33, 34 and 35, 36 respectively extend from the edges 31 and 32 that extend parallel to the extension of the individual plates. The tabs are bent upward at right angles to the bottom plate, and in each case press against the outer surfaces of the layering of the transformer core, or in other words against the long sides thereof, in the manner of a further plate. Besides the upper free edges, each of the tabs on one of the edges 31 or 32 have opposite first edges facing each other and opposite second edges 37, 38, 39 and 40 facing away from each other which are each flush with the outer surfaces of the two legs 15 and 16 and are transverse to the layering of the plates. The tabs and thus the bottom lamination or plate can be fastened to the two lamination packets with a single weld seam 41 which then overlaps the respective edges 39, 40 and 37, 38 of the tabs as well. In other words, the weld seam that joins the two lamination packets 11 and 12 also connects the edges 37–40 to the lamination packets, and thus the bottom lamination or plate or fastening element 30 is also fastened to the transformer. The width of the bottom lamination or plate is selected in such a way that it is exactly equivalent to the width or thickness (which may also be considered the height if the device is mounted on a wall) of the lamination stack, while the contrary is the case in the embodiment of FIG. 1 wherein the distance between the two edges 22 and 23 is precisely as long as the length of the transformer, as measured in the direction of the plates. The individual laminations or plates of each core lamination packet 11 and 12 are pressed against one another or joined with one another by means of rivets in holes 19, and the weld seam 14 serves merely to join the two core lamination packets 11 and 12. In the embodiment of FIG. 2, the tabs 33–36 have bores 42, which are aligned with the holes through which the rivets in the lamination packet 12 are guided. Thus the tabs 33–36 are additionally riveted to the lamination packet 12. The latter provision, in particular, has the advantage of providing good thermal coupling between the lamination packets 11 and 12 and the bottom lamination or plate 30.

FIGS. 1 and 2 in each case show only a single bottom lamination or plate or fastening element that is to be provided with the tabs. However, the invention also includes the possibility of the bottom lamination or plate or fastening element 20 or 30 being divided, or in other words being formed of two fastening elements provided with the holes 21 or with the tabs 33–36. In FIG. 1, such an element is suggested with broken lines in the form of respective elements 50 or 51. In the embodiment of FIG. 2, the broken outline indicates two fastening elements 52 and 53. In the final analysis, however, the embodiment without a division, as shown by solid lines in FIGS. 1 and 2, is more favorable.

It will be appreciated that the transformer is shown with the bottom lamination or plate fastened to it in FIGS. 1 and, 2, while a bottom lamination or plate is shown by itself in FIGS. 1*a* and 2*a*. The manufacture of the device is simply carried out by attaching the bottom lamination or plate to the transformer as indicated by the arrows P and then firmly welding.

The invention is described in connection with a transformer. Naturally, the invention is also applicable to chokes or to components that are assembled from two lamination packets including laminated metal sheets.

I claim:

1. Transformer, choke or the like, and fastening assembly comprising a magnetic core assembled from two lamination packets formed of laminations layered in a given direction, said lamination packets having outer contacting surfaces defining a partition line therebetween, a weld seam transverse to said given direction fastening said contacting surfaces to one another and overlapping said partition line, and a fastening element for fastening the transformer, choke or the like to a floor or a wall, upright tabs formed on said fastening element, said upright tabs having free edges alongside said partition line being partially welded with said weld seam.

2. The combination according to claim 1, wherein said lamination packets have opposite outer surfaces transverse to said given direction with a given spacing therebetween, said fastening element is a bottom lamination protruding beyond both sides of said lamination packets in said given direction and having two opposite edges extending across said laminations and being spaced apart exactly as far as said given spacing, a respective one of said tabs is bent upright perpendicular to said bottom lamination on each of said two opposite edges of said bottom lamination, said free edges of said tabs are parallel to said bottom lamination and disposed in the vicinity of said partition line, and said weld seam at said partition line incorporates said free edges of said tabs.

3. The combination according to claim 1, wherein said lamination packets have a given thickness and length, said fastening element is a bottom lamination having edges parallel to said lamination being mutually spaced apart by a distance corresponding to said given thickness, said tabs are bent upward on both of said edges of said bottom lamination, besides said free edges, each of said tabs on one of said edges of said bottom lamination having first edges facing each other and second edges facing away from each other transverse to said bottom plate, said second edges being mutually spaced apart by a distance corresponding to said given length, portions of said second edges are disposed in the vicinity of said partition line, and said second edges are overlapped by said weld seam.

4. The combination according to claim 3, wherein said tabs have bores formed therein each being in alignment with rivet bores formed in one of said lamination packets for riveting said tabs together.

* * * * *